United States Patent [19]

Wahren et al.

[11] 4,340,011

[45] Jul. 20, 1982

[54] FLOW DISTRIBUTOR FOR A LIQUID FILM DISCHARGING DEVICE

[75] Inventors: Douglas Wahren, Appleton, Wis.; Rolf A. L. Akesson, Karlstad, Sweden

[73] Assignee: Aktiebolaget Karlstads Mekaniska Werkstad, Karlstad, Sweden

[21] Appl. No.: 214,773

[22] Filed: Dec. 9, 1980

[30] Foreign Application Priority Data

Dec. 17, 1979 [SE] Sweden ..... 7910358

[51] Int. Cl.[3] ..... B05C 3/18

[52] U.S. Cl. ..... 118/410; 118/413

[58] Field of Search ..... 118/410, 413, 407, 411

[56] References Cited

U.S. PATENT DOCUMENTS

| | | | |
|---|---|---|---|
| 3,285,225 | 11/1966 | Recor . | |
| 3,418,970 | 12/1968 | Phelps et al. . | |
| 3,502,494 | 3/1970 | Ishiwata et al. | 118/411 |
| 3,521,602 | 7/1970 | Coghill | 118/410 |
| 4,023,526 | 5/1977 | Ashmus | 118/410 |

FOREIGN PATENT DOCUMENTS

| | | |
|---|---|---|
| 1319271 | 6/1973 | United Kingdom . |
| 1470349 | 4/1977 | United Kingdom . |

OTHER PUBLICATIONS

Pages 1-11, and 50-96 of the Book "Non-Newtonian Fluids", W. L. Wilkinson, Pergamon Press, Ltd., London, 1960.

*Primary Examiner*—Ralph S. Kendall

*Attorney, Agent, or Firm*—Bell, Seltzer, Park & Gibson

[57] ABSTRACT

In a device for producing from an outlet slot of constant width along its length, a flowing film of liquid with a velocity substantially constant over the length of the slot, a row of passageways, arranged in parallel with each other, connect a supply duct with the outlet slot. In order to reduce the demand for high precision and thus the associated cost of manufacture, the passageways are made of an elongate configuration and with a constant bore diameter along a length which is several times greater than the bore diameter. The restrictions preferably consist of tubes of varying length along the length of the outlet slot and a formula for determining the length of the tubes is given. The use of the device in a fountain applicator for coating webs is also described.

9 Claims, 4 Drawing Figures

FLOW DISTRIBUTOR FOR A LIQUID FILM DISCHARGING DEVICE

The present invention relates to a flow distributor for a liquid film discharging device. More particularly, the invention relates to a flow distributor device for producing from an outlet slot of constant width along its length, a flowing film of liquid having a substantially uniform velocity over the length of the slot.

The flow distributor device of the present invention has a supply duct for the liquid which extends substantially parallel to the elongate outlet slot, and means is provided for feeding the liquid at a constant but adjustable rate of flow to the supply duct. A plurality of individual passageways or restrictions extend in fluid communication between the supply duct and the elongate outlet slot and thus provide for directing the liquid from the supply duct to the elongate outlet slot. These passageways are arranged in a row connected in parallel with each other and are equidistantly spaced along the length of the supply duct. The passageways are located sufficiently close to each other to avoid unacceptable nonuniformity in the flow from the outlet slot occasioned by local velocity gradients which arise from the passageways and which could remain after a possible deflection of the direction of flow between the passageways and the outlet slot. The passageways are dimensioned so as to make the pressure drop across the row of passageways greater than the pressure drop across the supply duct and greater than the pressure drop across the elongate outlet slot.

The flow distributor device of this invention is particularly useful in a type of coating apparatus known as a fountain applicator wherein a web, such as paper, is directed across an elongate outlet opening provided in the applicator and a film of a liquid coating material is applied to the surface of the web.

A fountain applicator of this general type is disclosed in Phelps et al U.S. Pat. No. 3,418,970. This device comprises an applicator bar with a longitudinal groove or slot of constant width along its length, and a row of holes opening into the bottom of the groove. The applicator bar is attached in sealing relation to a supply tube provided with a similar row of holes. Between the applicator bar and the supply tube, a metering bar can be arranged with a similar row of metering holes in alignment with the separate holes in the row of holes in the applicator bar and the row of holes in the supply tube. The metering holes are shown to have a diameter which is several times bigger than the axial length of the holes, whereby the resultant restriction of each hole is of the same kind as that obtained with a thin orifice plate. In order to ensure that the flow from the groove is uniform over the length of the groove or slot, it is theoretically feasible to let the supply tube have a constant cross sectional area and adjust the diameter of the metering holes, hole by hole, so that the flow rates through the holes will be equal to each other. In practice, however, the hole diameter has proved to be so critical that it is difficult to obtain a uniform flow rate over the length of the groove or slot by this method.

A somewhat similar type of fountain applicator is disclosed in Recor U.S. Pat. No. 3,285,225. In this device, the web is directed across a coating chamber which is fed with a liquid coating by a series of spaced passageways or holes arranged across the width of the coating chamber and communicating with a supply conduit. Each passageway has a restricted lower end for obtaining a more uniform flow across the width of the coating chamber. This restricted end portion serves a similar function as the metering holes provided in the Phelps et al patent. Consequently, the dimensions of the restrictions become critical, and, as in the arrangement shown in the Phelps et al patent, it is difficult to obtain a uniform flow rate by this arrangement.

The main object of the present invention is to provide a flow distributor device which is designed in such a manner that the exacting demands for accuracy in manufacture of the same can be reduced substantially without sacrificing uniformity of flow rate over the length of the elongate outlet slot.

According to the invention, this object is achieved in that the passageways which provide fluid communication between the supply duct and the outlet slot are of an elongate configuration and have a uniform bore diameter along a length which is several times greater than the diameter of the bore. Preferably, the passageways have a length at least as great as half the dimension of the supply duct measured in the lengthwise direction of the passageway, whereby a uniform distribution of flow is more easily attained. Also according to the invention the elongate passageways can have differing lengths along the length of the supply duct for providing a uniform distribution of flow along the length of the slot.

When the liquid is a suspension and contains suspended particles, for example the liquid can be a coating slip, it is desirable that the bore diameter of the restrictions be at least about 6 mm, and preferably at least about 8 mm, in order to avoid clogging and similar functional troubles caused by aggregation of the particles.

It is desirable that the supply duct have a diameter of at least about 0.1 meter, preferably at least about 0.15 meter. By using such a large diameter the prerequisite conditions for laminar flow will increase and therewith a more uniform distribution of the flows through the elongate passageways.

In some cases, if desired, the far end of the supply duct, as seen in the direction of flow, may be provided with an outlet for recirculation of part of the liquid in order to thereby facilitate the attainment of a uniform flow rate over the length of the outlet slot.

In a preferred embodiment of the invention, the elongate passageways are tubular and extend into the supply duct, preferably up to the center of the supply duct. In this way the entrances to the passageways are located where the local velocity gradients for the flow through the supply tube are a minimum and where the flow is steadiest and most suitable for obtaining a uniform flow rate along the length of the outlet slot.

Preferably, the lengths of the restrictions will comply with the formula $$l = \lambda - L \cdot \frac{N}{M} \cdot \left(\frac{d}{D}\right)^{3b+4} \cdot \frac{M(1 + R/100) - N^{1+b}}{1 - R/100} - k \cdot N$$

where $\lambda$ is the selected maximum length of the restrictions,

L is the length of the outlet slot,

N is the ordinal number of the passageway the length of which is to be calculated, M is the total number of passageways in said row, d is the bore diameter of the passageway the length of which is to be calculated, D is the diameter of the supply duct, b is the slope of the viscosity curve of the liquid, approximated to a straight line, in a log-log diagram with the dynamic viscosity of the liquid as ordinate and the rate of shear of the liquid as abscissa, R is the recirculation flow rate as a percentage of the total flow rate in the supply duct, k is an empirically determined constant with a value between 0 and 1, approaching 0 when starting from the wall of the supply duct the positions of the inlets of the restrictions approach the center of the supply duct, and l is the ideal length of the passageway with the ordinal number N, and where a plurality of passageways following each other in a sequence within the row and having essentially the same ideal length may be manufactured with the same length as each other. An adaption of the length of the passageways to this formula will considerably facilitate the attainment of a uniform flow rate over the length of the outlet slot, particularly if the liquid is a non-Newtonian fluid.

Regarding the classification of non-Newtonian fluids and regarding the flow of these liquids in tubes and ducts, refer to Wilkinson, W. L., *Non-Newtonian Fluids*, London (Oxford, New York, Paris) 1960, pp. 1–19 and 50–92.

The invention can be applied in a number of different fields, e.g. extrusion of a web of polymeric material from a slot (cf. pp. 86–92 in said publication by Wilkinson) or laminating or surface sizing of a paper web. However, the main advantages are obtained when coating paper webs with a coating slip. Such a coating slip is rheologically a non-Newtonian fluid, as a rule with predominant pseudoplastic properties, such that—at least within the laminar range—the viscosity of the liquid decreases with increased rate of shear of the liquid. Previously, this phenomenon has made it very difficult to attain an acceptably uniform flow from the outlet slot of a fountain applicator for coating webs of material.

The invention will now be described in greater detail with reference to the accompanying drawings.

Figure 1:
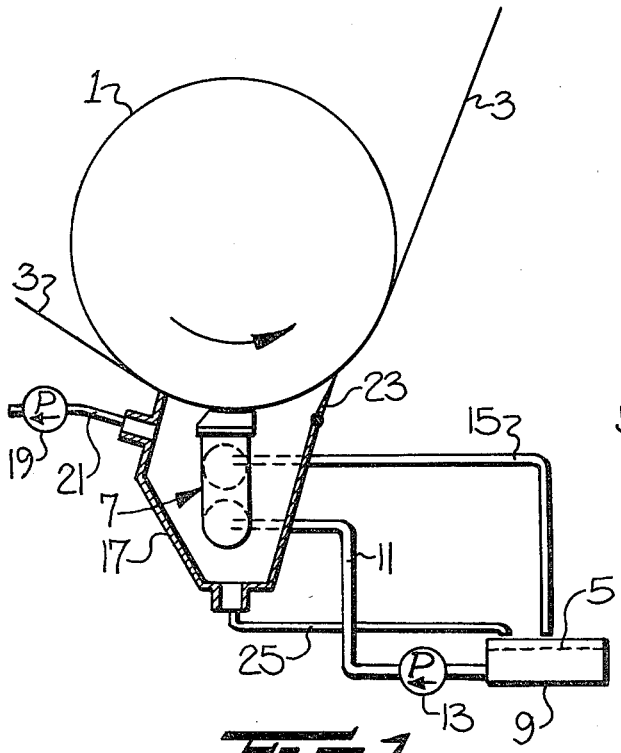
FIG. 1 is a schematic view in side elevation of a coating station comprising a fountain applicator in which a preferred embodiment of the device according to the invention is used.

In the coating station shown in FIG. 1 a travelling web of paper 3, supported by a backing roll 1, is being coated with a coating slip 5, which is applied to the web by means of a fountain applicator 7. Coating slip is a slurry for coating paper or board and contains pigment in a solution of binder and possibly dyes, dispersing agent, viscosity controlling agent etc., and—at least with moderate pigment content—it can be classified as a non-Newtonian fluid of pseudoplastic type, where the dynamic viscosity $\mu$ decreases with increasing rate of shear $\gamma$.

The coating slip 5 is fed from a tank 9 to the fountain applicator 7 through a supply line 11 by means of a pump 13, suitably of the type that can discharge a constant but adjustable flow rate, e.g. a Mono pump. A Mono pump is a positive displacement pump having a resiliently deformable stator shaped like a double internal helix and a single helical rotary piston which travels in the stator with a slightly eccentric motion. A recirculation pipe 15 for coating slip runs from the fountain applicator 7 back to the tank 9. The fountain applicator 7 is enclosed in a vacuum box 17, which is open to a part of the portion of the web 3 supported by the backing roll 1. A vacuum fan 19 or similar device for producing a vacuum of required moderate level is connected to the inside of the box 17 by a pipe 21. An upper portion of a rear wall of the box 17, as seen in the direction of travel of the web 3, is designed as a pivoted blade 23 for smoothing the layer of coating applied by the fountain applicator 7 and doctoring off any excess coating. Such excess coating is allowed to run into the bottom of the box 17, from whence it is returned to the tank 9 through a pipe 25.

Figure 2:
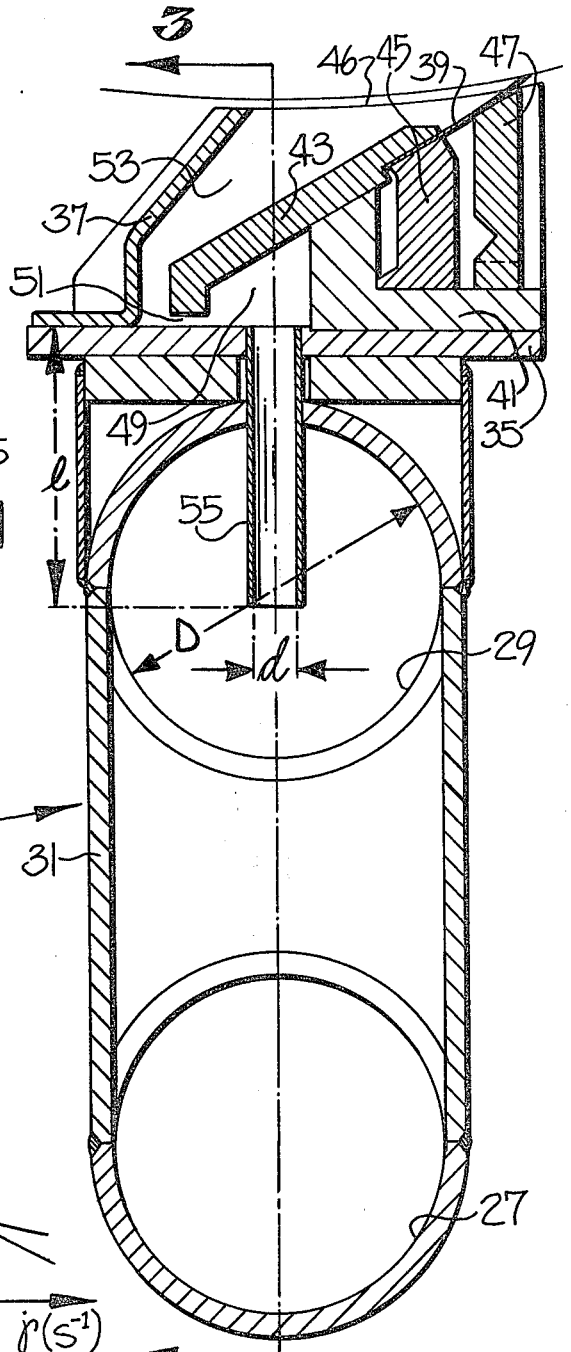
FIG. 2 is a cross sectional view of the fountain applicator.
Figure 3:
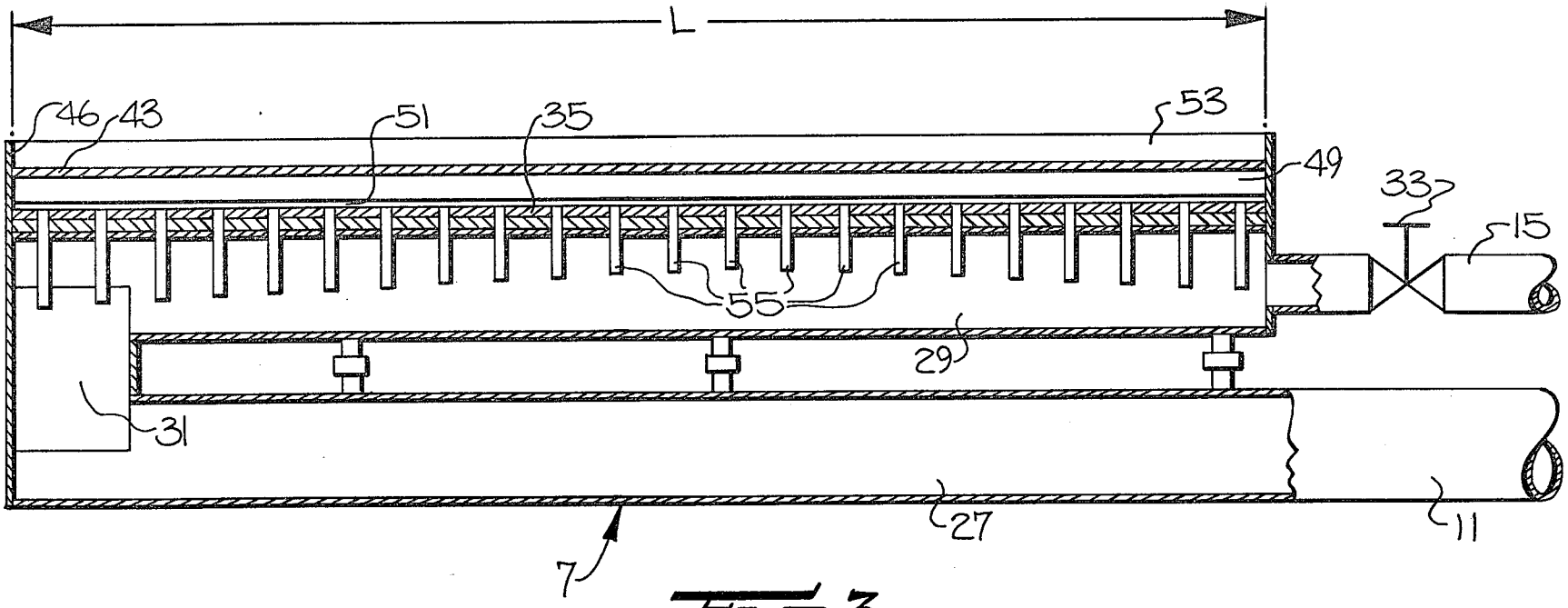
FIG. 3 is a longitudinal sectional view of the fountain applicator, taken along the line 3—3 of FIG. 2.

The fountain applicator 7 is shown in greater detail in FIGS. 2 and 3. In the embodiment shown it comprises two relatively large pipes, a bottom pipe 27 and a top pipe 29, which have the same diameter and run slightly apart from each other across the width of the web 3 and parallel to each other and to the backing roll 1. The bottom pipe 27 is connected at one end to the coating slip supply pipe 11 or forms an integral part of this pipe. The other end of the pipe 27 is connected by a transverse passage 31 to the adjacent end of the top pipe 29, to the opposite end of which is connected the recirculation pipe 15 with a throttle valve 33 for setting a selected recirculation flow.

The fountain applicator 7 also comprises an elongate fountain head mounted on top of the top pipe 29 and having a base plate 35, a front edge strip 37 inclined backwards in relation to the direction of travel of the web 3 and designed to terminate a short distance from the face of the backing roll 1, a blade 39 inclined still further backwards and designed to terminate less than 1 mm from the backing roll 1, a base strip 41 attached to the base plate, a front clamping strip 43 and a rear clamping strip 45 attached to the base strip 41 for clamping the blade 39 between them, and two end covers 46, one of which is shown, and a blade loading strip 47. One of the narrow sides of this strip 47 is attached to the top of the base strip 41 and its other narrow side is chamfered and contacts the bottom of the blade 39 near the edge of its free long side. At some distance from the bottom narrow side of the strip 47 a relatively deep groove is arranged in one of the wide sides of this strip and extends along its length. There are also a plurality of vertical slits extending from the chamfered narrow side down to the bottom edge of the groove, so that the blade loading strip 47 is divided into several tongues, which can be bent slightly, independent of one another, in the area of the groove by means of adjusting screws, not shown, extending into the rear clamping strip 45 and used for fine adjustment of the blade 39 clearance to the web 3 supported by the backing roll 1.

The base plate 35, the base strip 41 and the bottom of the front clamping strip 43 enclose between themselves a deflection chamber 49, which is in communication with the outlet slot 53 of the fountain applicator through an opening 51 formed between the base plate 35 and front clamping strip 43, the outlet slot 53 being formed between the back of the front clamping strip 37 and the top of the front clamping strip 43 and the blade 39 and diverging in the direction of flow but having a constant width along its length across the direction of travel of the web 3.

The inside of the top pipe 29 constitutes an inlet duct or supply duct for the liquid or coating slip 5, and this duct extends substantially parallel to the outlet slot 53. The supply duct 29 is connected to the outlet slot 53 by means of a plurality of passageways or restrictions 55 arranged in a row, connected in parallel to each other and equidistantly spaced along the length of the duct 29. These passageways, which are shown to open out into the deflection chamber 49, are located sufficiently close to each other to avoid giving an unacceptable nonuniformity in the flow from the outlet slot 53 as a result of local velocity gradients, which are caused by the passageways and which could remain after a change in the direction of flow in the deflection chamber 49 and at the opening 51. Further, the passageways 55 are proportioned so that the pressure drop across the row of passageways is greater than the pressure drop across the supply duct 29 and greater than the pressure drop across the flow path downstream of the passageways 55.

According to the invention, the passageways 55 are elongate and have a constant bore diameter d along a length l, which is several times greater than the bore diameter. In the preferred embodiment shown in FIGS. 2 and 3, the passageways comprise tubes 55, which extend from the base plate 35 to the vicinity of the center of the supply duct 29. In order to obtain a smooth and steady flow, it is desirable that turbulent conditions be avoided in the duct 29. A suitable diameter D for the supply duct 29 is therefore at least about 0.1 meter, preferably at least about 0.15 meter. This means that the passageways 55 can be given a considerable length in relation to their bore diameter without disadvantages. While the length l of the shortest passageway is desirably at least equal to half the size (D/2) of the supply duct 29 in the lengthwise direction of the passageways, the bore diameter d of the passageways 55 should be at least about 6 mm, preferably at least about 8 mm, at least when the liquid is a suspension such as a coating slip, in order to avoid not only clogging but also the troubles that are associated with the initial stage of complete obstruction.

It has proved to be particularly advantageous to let the lengths of the passageways 55 conform to the formula $$l = \lambda - L \cdot \frac{N}{M} \cdot \left(\frac{d}{D}\right)^{3b+4} \cdot \frac{M(1 + R/100) - N^{1+b}}{1 - R/100} - k \cdot N$$

where

- λ is the selected maximum length of the passageways 55,
- L is the length of the outlet slot 53,
- N is the ordinal number (in the direction of flow through the supply duct) of the passageway 55 the length of which is to be calculated,
- M is the total number of passageways 55 in said row,
- d is the bore diameter of the passageway 55 the length of which is to be calculated,
- D is the diameter of the supply duct 29,
- b is the slope of the viscosity curve of the liquid 5, approximated to a straight line, in a log-log diagram (see FIG. 4) with the dynamic viscosity (μ) of the liquid 5 as ordinate and the rate of shear (γ) of the liquid as abscissa,
- R is the recirculation flow rate through the pipe 15 as a percentage of the total flow rate in the supply duct 29,
- k is an empirically determined constant with a value between 0 and 1, approaching 0 when starting from the wall of the supply duct 29 the positions of the inlets of the passageways 55 approach the center of the supply duct 29, and
- l is the ideal length of the passageway 55 with the ordinal number N, and where a plurality of passageways 55 following each other in sequence within the row and having essentially the same ideal length (l) may be manufactured with the same length as each other.

Figure 4:
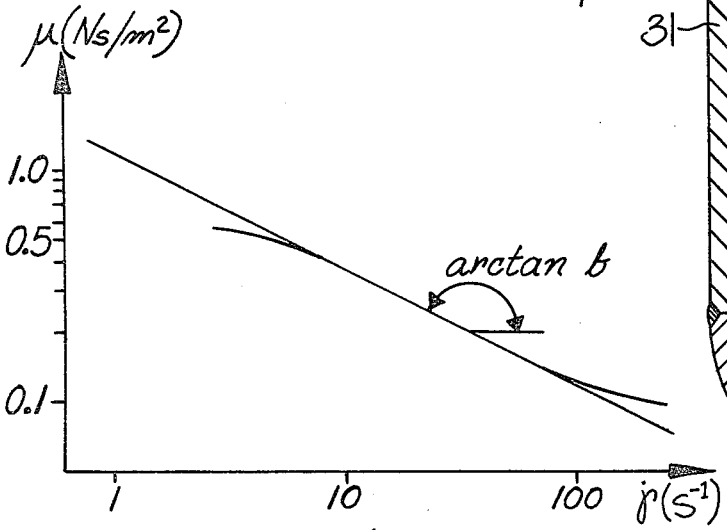
FIG. 4 is a viscosity diagram for a non-Newtonian fluid, namely a coating slip, and shows how the dynamic viscosity $\mu$ changes with the rate of shear $\gamma$.

Viscosity curves of the type shown in FIG. 4 must be prepared for every liquid for which the slope is required to be determined. The viscosity curve shown in FIG. 4 refers to a coating slip with a dynamic viscosity of 1.216 $Ns/m^2$ at a rate of shear of $1s^{-1}$ with a slope of −0.5. If, additionally, λ is 90 mm, L is 2 m, M is 66 (the pitch between the restrictions is then 30.3 mm), d is 8 mm, D is 0.1 m, R is 0% and k is 0, the following relationship between N and l is obtained:

| N | l (mm) |
|---|---|
| 1 | 89.6 |
| 4 | 88.3 |
| 7 | 87.1 |
| 10 | 85.9 |
| 13 | 84.8 |
| 16 | 83.8 |
| 19 | 82.9 |
| 22 | 82.0 |
| 25 | 81.2 |
| 28 | 80.5 |
| 31 | 79.9 |
| 34 | 79.5 |
| 37 | 79.1 |
| 40 | 78.8 |
| 43 | 78.7 |
| 46 | 78.7 |
| 49 | 78.9 |
| 52 | 79.3 |
| 55 | 80.0 |
| 58 | 81.0 |
| 61 | 82.5 |
| 64 | 85.0 |

As can be seen, the passageway length l decreases gradually from an initial value to a minimum value, which is attained when approximately two thirds of the number of restrictions have been passed, to then increase gradually to a final value at a lower level than the initial value. If the slope b increases from its above-mentioned negative value toward zero, the difference in length between the longest and the shortest passageway diminishes. The more negative b is, the further the position of the shortest passageway will be displaced toward the last passageway in the row in the direction of flow. An increase of the recirculation flow rate will give a corresponding displacement of the position of the shortest passageway. A large recirculation flow rate together with a pronounced negative value of the slope b can result in the last passageway in the row also being the shortest.

The slope b is negative for pseudoplastic fluids, zero for Newtonian fluids—i.e. the viscosity is independent of the rate of shear $\gamma$—and positive for dilatant fluids.

The deviation of the viscosity curve in FIG. 4 from a straight line at high rates of shear probably depends on a transition from laminar to incipient turbulent flow as an orientation of the chain molecules of the fluid in the direction of flow.

The invention is not limited to the preferred embodiments described above and shown in the drawings, but can be varied within the scope of the claims that follow. For example, in some cases—e.g. when the liquid is Newtonian instead of pseudoplastic and therefore has a velocity profile that is more pointed—it can be suitable that all passageways 55 extend exactly to the center of the supply duct 29 and instead they project different lengths into the deflection chamber 49.

Further, it is possible that instead of using passageways in the form of tubes 55 as shown, the passageways can be designed as a row of suitably reamed bores in a bar with the thickness varying along its length. Alternatively, the bar can have a constant thickness and the bores be stepped bores instead with a diameter increasing from one value to another when the intended length of the passageway has been reached. If optimum flow conditions are aimed at in the supply duct 29, the bottom tube 27 and the transverse passage 31 should be replaced by an entry run located immediately before the first passageway in the row. This entry run to be straight and coaxial with the supply duct 29 and have a constant diameter the same as the diameter of the duct 29 and have a length that is sufficient to allow a velocity profile normal for the liquid to be formed before the first passageway.

In addition, the vacuum box 17 and the vacuum fan 19, the pipe 21 and the blade 23 can be replaced, if desired, by a conventional separate blade with a conventional loading device together with a trough for collecting the excess coating doctored off. It is also possible in a known way to exchange the blade for a rotatable doctor rod.

It can easily be seen that the invention as described above can be applied not only to fountain applicators for coating or other surface applications, for example surface sizing, of paper webs and similar webs of material, but also for other devices for producing an outflowing film of liquid from an outlet slot of constant width along its length, the discharge velocity being substantially constant along the length of the slot, for example devices for producing a web-shaped sheeting of polymeric material by extrusion of a polymer melt.

In the drawings and specification, there has been set forth a preferred embodiment of the invention, and although specific terms are employed, they are used in a generic and descriptive sense only and not for purposes of limitation.

That which is claimed is:

1. A flow distributor device for producing from an elongate outlet slot of substantially constant width along its length, a flowing film of liquid with a substantially uniform velocity over the length of the slot, said device comprising a supply duct extending substantially parallel to the elongate outlet slot, means for feeding a liquid at a constant but adjustable rate of flow to said supply duct, and a plurality of elongate passageways providing fluid communication between said supply duct and the outlet slot, said passageways being arranged in a row connected in parallel with each other and equidistantly spaced along the length of the supply duct, said passageways being located sufficiently close to each other to avoid unacceptable nonuniformity in the flow from the outlet slot, occasioned by local velocity gradients which arise from the passageways, said passageways being dimensioned so as to make the pressure drop across the row of passageways greater than the pressure drop across the supply duct and greater than the pressure drop across the slot, and wherein each of said elongate passageways has a uniform bore diameter along a length which is several times greater than the bore diameter, and wherein said elongate passageways have differing lengths along the length of the supply duct for providing a more uniform distribution of flow along the length of the elongate outlet slot.

2. A device according to claim 1 wherein the bore diameter of said elongate passageways is at least about 6 mm.

3. A device according to claim 1 wherein said supply duct has a diameter at least about 0.1 meter.

4. A device according to claim 1 wherein said means for feeding a liquid to the supply duct is connected to one end of the supply duct, and including an outlet connected to the opposite end of the supply duct for receiving liquid from the supply duct.

5. A device according to claim 1 wherein said elongate passageways are tubular and extend into the supply duct.

6. A device according to claim 1 wherein the lengths of said elongate passageways essentially conform to the formula $$l = \lambda - L \cdot \frac{N}{M} \cdot \left(\frac{d}{D}\right)^{3b+4} \cdot \frac{M(1 + R/100) - N^{1+b}}{1 - R/100} - k \cdot N$$

where $\lambda$ is the selected maximum length of the passageways,

L is the length of the outlet slot,

N is the ordinal number of the passageway the length of which is to be calculated, M is the total number of passageways in said row, d is the bore diameter of the passageway the length of which is to be calculated, D is the diameter of the supply duct, b is the slope of the viscosity curve of the liquid, approximated to a straight line in a log-log diagram with the dynamic viscosity of the liquid as ordinate and the rate of shear of the liquid as abscissa, R is the recirculation flow rate as a percentage of the total flow rate in the supply duct, k is an empirically determined constant with a value between 0 and 1, approaching 0 when starting from the wall of the supply duct the positions of the inlets of the passageways approach the center of the supply duct, and l is the ideal length of the passageway with the ordinal number N, and where a plurality of passageways following each other in sequence within the row and having essentially the same ideal length may be manufactured with the same length as each other.

7. A device according to claim 1 wherein the length of each elongate passageway is at least as great as half the diameter of said supply duct.

8. In a fountain applicator for applying a liquid coating to a moving web, and including an elongate outlet slot of substantially constant width along its length and means for directing a web past said elongate outlet slot for receiving a liquid coating therefrom, the combination therewith of a flow distributor device constructed for producing from said elongate outlet slot, a flowing film of liquid with a substantially uniform velocity over the length of the slot so that more uniform coating of the liquid is applied to the web, said flow distributor device comprising a supply duct extending parallel to said elongate outlet slot, means for feeding a liquid at a constant but adjustable rate of flow to said supply duct, and a plurality of elongate passageways providing fluid communication between said supply duct and said outlet slot, said passageways being arranged in a row connected in parallel with each other and equidistantly spaced along the length of the supply duct, said passageways being located sufficiently close to each other to avoid unacceptable nonuniformity in the flow from the outlet slot, occasioned by local velocity gradients which arise from the passageways, said passageways being dimensioned so as to make the pressure drop across the row of passageways greater than the pressure drop across the supply duct and greater than the pressure drop across the slot, and wherein each of said elongate passageways has a uniform bore diameter along a length which is several times greater than the bore diameter and wherein said elongate passageways have differing lengths along the length of the supply duct for providing a more uniform distribution of flow along the length of said elongate outlet.

9. A combination according to claim 8 wherein the length of each elongate passageway is at least as great as half the diameter of said supply duct.

* * * * *